United States Patent [19]

Kneissl

[11] 4,346,810

[45] Aug. 31, 1982

[54] CLOSURE FOR BOTTLES

[75] Inventor: Richard Kneissl, Munich, Fed. Rep. of Germany

[73] Assignee: Nova-Handels AG, Zurich, Switzerland

[21] Appl. No.: 185,535

[22] Filed: Sep. 9, 1980

[30] Foreign Application Priority Data

Sep. 11, 1979 [DE] Fed. Rep. of Germany ..... 2936717

[51] Int. Cl.[3] ..... B65D 43/16

[52] U.S. Cl. ..... 215/237; 220/335; 222/517

[58] Field of Search ..... 222/498, 517; 215/244, 215/245, 237, 235; 220/335

[56] References Cited

U.S. PATENT DOCUMENTS 3,933,271 1/1976 McGhie ..... 222/517 X 4,234,103 11/1980 Strobl et al. ..... 222/517 X

*Primary Examiner*—Donald F. Norton

*Attorney, Agent, or Firm*—Zarley, McKee, Thomte, Voorhees & Sease

[57] ABSTRACT

The present invention is a bottle closure means which utilizes a cap hinged to a collar which is in turn mounted on the bottle. The invention has a spring-action strip which yieldably forces the cap into a closed position, thus sealing the bottle.

8 Claims, 4 Drawing Figures

CLOSURE FOR BOTTLES

BACKGROUND OF THE INVENTION

This invention relates to bottle closure means. Closure means of this type are produced in many countries by the millions and used for all sorts of bottles, for instance for cleansing agents and cosmetics. In these closure means, the cap is held in two possible stable positions by the springacting strip, namely, in the open position and in a position shortly preceding the closure position.

These closure means suffer from the drawback that while the cap can be opened by one manual action, two manual operations on the other hand are required for closing. The geometry in the closure means known so far is such that the spring-acting strip loses its tension during the closing procedure before the cap closes completely. Accordingly, closure means of this kind ordinarily are provided with a snap connection which require first flipping over the cap into the closure position and second, snapping the closure into position by further pressing the cap.

SUMMARY OF THE INVENTION

It is the object of the present invention to further develop closure means of the mentioned type that are free from the above cited shortcoming in that the cap once it has snapped beyond the dead or reversal point automatically arrives in the closure position and if appropriate, also implements thereby a snap-in connection.

This problem is solved by the invention (shown in FIG. 4) in that for such a closure means in the open state of the cap and for relaxed spring strip, the angle (alpha) between the straight line G' through the hinge points FD' and DK and the straight line G through the same points when the cap is in its reversal dead position is larger than the corresponding angle in the closed state of the cap (angle beta).

To keep such a cap reliably closed and to make sure any snap connection will snap, the angle alpha shall be at least 5°, especially at least 10°, and preferably at least 20° larger than the angle beta.

Ordinarily such closure means are manufactured by injection molding machines, whereby the closure means must be so made that after being ejected from the mold, the cap will be in an open position swung out by 180°, the spring acting strip naturally also being made in that position, in which it is relaxed. Where closure means are made in this manner, preferably the straight line G, and the longitudinal axis of the collar intersect at an acute angle above the seal. This acute angle may be about 1° to 20°, especially 5° to 20° and preferably 10° to 20° in order to provide a sufficient compression of the closed cap against the collar.

To obtain such a geometry, the simplest way is for the hinge point FK to be on a projection of the collar and farther away from the center axis of this collar than the hinge point DK.

Because the spring acting strip is under higher stress in the closure means of the invention and because also it remains under stress when the cap is in the closed position, this spring strip preferably will be reinforced in the middle region. When arcuate in shape, it may be like a new moon, but when angular, the reinforcement preferably will be at the lower side of such a knee. The reinforcements are located in the middle region of the spring acting strip because the highest righting forces act there when the spring acting strip is stressed.

In the known closure means that part sealing the pour aperture of the collar ordinarily consists of a pin with a small reinforced head simultaneously forming a snap seal. To facilitate the snapping shut of the cap in the closure means of the invention, such a pin passing into the pour aperture preferably will not be in the shape of a small head but rather in that of a slight cone. As the cap in the closure means of the invention is kept in its sealing position by the spring acting strip, the slightly conical pin need not have an undercut for snapping into the pour opening. However, such an undercut may be provided if desired.

DETAILED DESCRIPTION OF THE INVENTION

Figure 1:
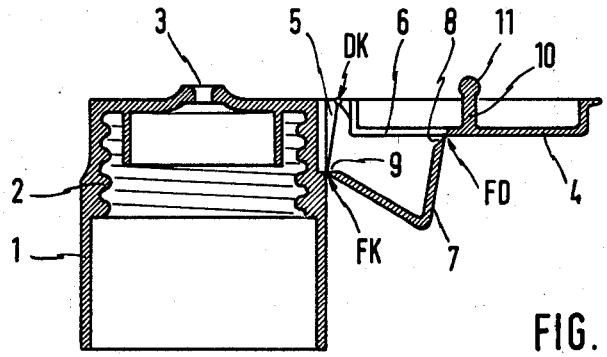
FIG. 1 PRIOR ART
FIGS. 1 and 2 are a section and a top view, respectively, of an open, known closure means as defined by the preamble of the present independent claim.

Both the known closure means and that of the invention consist of a collar 1 with an internal thread 2 for screwing onto a bottle. The collar furthermore comprises a pour opening 3. A cap 4 is hinged through a spring hinge 5 to the hinging point DK at the rim of the collar 1. The cap at its center comprises a clearance 6 which divides the spring hinge 5 and serves to receive an angled spring acting strip 7 which is hinged on one hand to hinging point FD by means of a spring hinge 8 and on the other hand to the hinging point FK by means of a spring hinge 9. A sealing component 10 with a head 11 at the cap 4 snaps into the sealing position in the pour opening 3 and forms a liquid tight seal.

Figure 3:
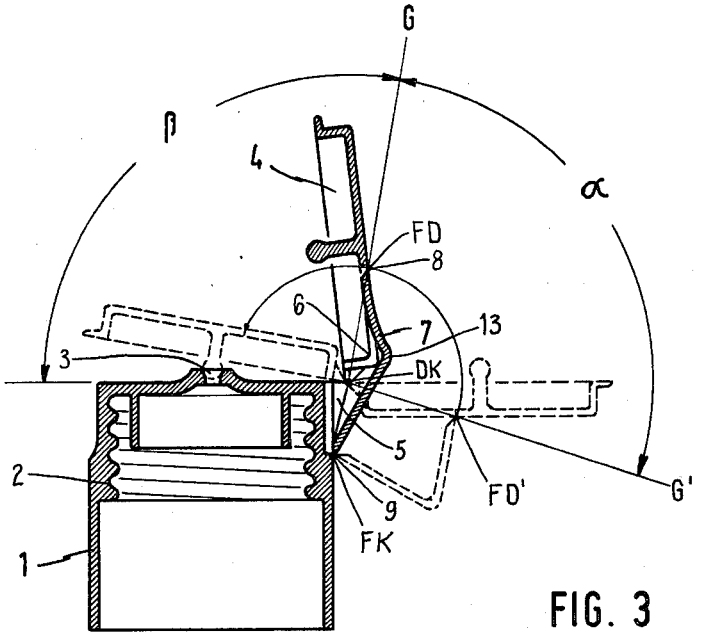
FIG. 3 PRIOR ART
FIG. 3 shows the geometric relationships when closing a closure means of FIGS. 1 and 2.

FIG. 3 shows that in the known closure means, the angle Alpha between the straight line G at which the cap is in the dead or reversing position and the straight line G' passing through the hinging points DK and FD' in the open position of the cap does not exceed the corresponding angle (Beta) for the cap in the closed position. Therefore the cap following its reversal toward the closed position only arrives at the position indicated in dashed lines. In that position the spring acting strip already has lost its spring force and is no longer capable of moving the cap completely into the sealing position.

Figure 2:
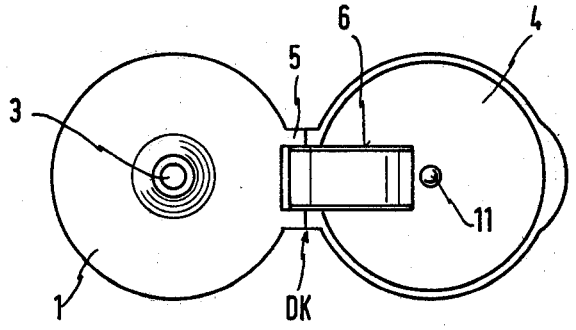
FIG. 2 PRIOR ART
Figure 4:
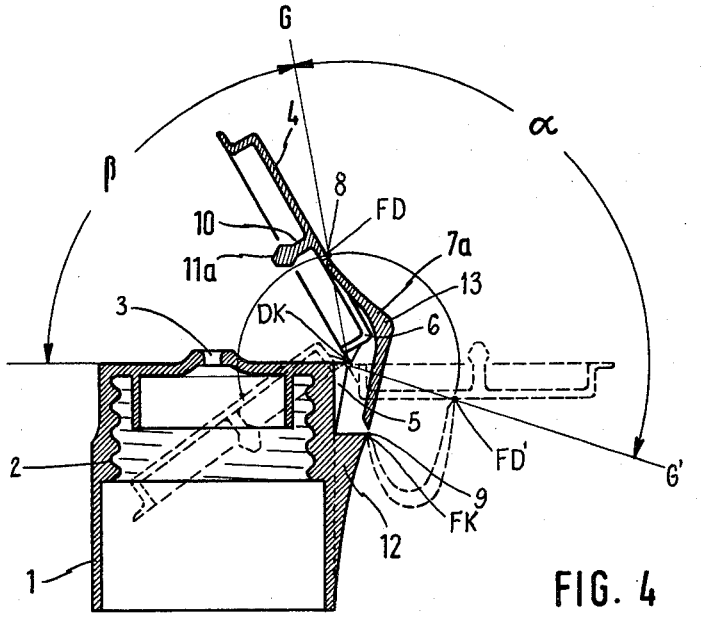
FIG. 4 is an embodiment of a closure means of the invention showing the geometric relationships when sealing the closure means.

The embodiment of the invention shown in FIG. 4 differs from the known one in FIGS. 1 through 3 in that the hinging point FK is located on a projection 12 on the collar so that the straight line G forms an acute angle with the longitudinal axis of the collar, the apex of said angle being above the closure means. Therefore, the corresponding angle Alpha is substantially larger than the angle beta. With the invention shown in FIG. 4, when the cap is in the closed position, the spring strip 7*a* still retains its spring force. Thus, when the cap is moving toward the closing position, sufficient spring force remains to force the conical pin 11*a* into the pour aperture 3 and thus also to overcome any resistance to snap sealing. FIG. 4 shows the theoretical rest position for a relaxed spring acting strip, also in dashed lines.

The closure means of the invention differs from the known one primarily by the projection 12, by a reinforcement or thickened portion 13 in the middle region of the spring acting strip *7a*, and by a conical pin 11*a*. These structural features permit the over center or dead position of the cap, (the position when spring clip 7 commences acting on the cap to close it) to be such that angle alpha is greater than angle beta. Furthermore, they insure that spring strip 7 imparts a downward force on the cap at its fully closed position.

What is claimed is:

1. A bottle closure means adapted to be mounted on the upper end of a bottle neck, said closure comprising:

a cylindrical collar having a pour opening formed therein;

a cap hinged to said collar and having a sealing member thereon for engaging and sealing said pour opening, said cap being movable about a cap hinge axis from an open position wherein said sealing member is spaced from said pour opening to a closed position wherein said sealing member engages and seals said pour opening;

at least one spring acting strip having a first hinged connection to a collar projection at a first hinged point and a second hinged connection to said cap at a second hinged point, said cap being movable to a reversal position between said open and closed positions wherein said spring acting strip commences imparting a force on said cap to move said cap to said closed position;

said collar, cap and spring strip being integrally formed from plastic and being mutually joined by plastic hinges at said hinge axis, said first hinged point and said second hinged point;

a first angle being formed by a first line passing through said second hinged point and said hinge axis when said cap is in said open position and a second line passing through the same points when said cap is in its said reversal position;

a second angle being formed by said second line and a third line passing through the same points when said cap is in said closed position;

said second angle being smaller than said first angle.

2. A closure means according to claim 1 wherein said first angle is at least 5° greater than said second angle.

3. A closure means according to claim 2 wherein said first angle is at least 10° greater than said second angle.

4. A closure means according to claim 3 wherein said first angle is at least 20° greater than said second angle.

5. A closure means according to claim 1 wherein said spring acting strip is relaxed when said cap is in said open position and said second line intersects the longitudinal axis of said collar above the said closure means to form an acute angle.

6. A closure means according to claim 5 wherein said first hinging point is further removed from the longitudinal axis of said collar than said cap collar hinge axis.

7. A closure means according to claim 1 wherein said spring acting strip is elongated and is reinforced intermediate its opposite ends.

8. A closure means according to claim 1 wherein said sealing member comprises a conically shaped pin insertable into said pour opening.

* * * * *